US010683122B2

(12) United States Patent
Bahr

(10) Patent No.: US 10,683,122 B2
(45) Date of Patent: Jun. 16, 2020

(54) ILLUMINATED DOOR INDICATOR FOR AUTOMATED MACHINERY

(71) Applicant: MGS MACHINE CORPORATION, Maple Grove, MN (US)

(72) Inventor: Richard Allen Bahr, Maple Grove, MN (US)

(73) Assignee: MGS MACHINE CORPORATION, Maple Grove, MN (US)

( * ) Notice: Subject to any disclaimer, the term of this patent is extended or adjusted under 35 U.S.C. 154(b) by 0 days.

(21) Appl. No.: 16/175,309

(22) Filed: Oct. 30, 2018

(65) Prior Publication Data

US 2020/0055626 A1 Feb. 20, 2020

Related U.S. Application Data

(60) Provisional application No. 62/719,967, filed on Aug. 20, 2018.

(51) Int. Cl.

| | |
|---|---|
| ***G08B 21/00*** | (2006.01) |
| ***B65B 57/18*** | (2006.01) |
| ***F21V 33/00*** | (2006.01) |
| ***G08B 5/38*** | (2006.01) |
| *F21W 131/403* | (2006.01) |
| *F21Y 103/10* | (2016.01) |
| *F21Y 113/13* | (2016.01) |
| *F21Y 115/10* | (2016.01) |

(52) U.S. Cl.

CPC ..... *B65B 57/18* (2013.01); *F21V 33/00* (2013.01); *G08B 5/38* (2013.01); *F21W 2131/403* (2013.01); *F21Y 2103/10* (2016.08); *F21Y 2113/13* (2016.08); *F21Y 2115/10* (2016.08)

(58) Field of Classification Search

CPC ..... B65B 57/18; B65B 65/00; B65B 7/20; G08B 5/38; G08B 3/10; G08B 5/36; G08B 21/182; F21V 33/00; F21Y 2115/10; F21Y 2113/13; F21Y 2103/10; F21W 2131/403

USPC ..... 340/679, 680, 691.1, 693.5, 691.3

See application file for complete search history.

(56) References Cited

U.S. PATENT DOCUMENTS

| | | | |
|---|---|---|---|
| 3,867,621 | A | 2/1975 | Gewfrtz et al. |
| 4,825,615 | A | 5/1989 | Turner |
| 5,018,330 | A | 5/1991 | Lewkowitz |
| 5,499,165 | A | 3/1996 | Holmes, Jr. |
| 5,555,654 | A | 9/1996 | Hermann |
| 5,983,543 | A | 11/1999 | Hillstrom |
| 6,059,420 | A | 5/2000 | Rogers |
| 6,736,534 | B1 | 5/2004 | Fite |

(Continued)

FOREIGN PATENT DOCUMENTS

| | | | |
|---|---|---|---|
| AT | 11965 | U1 | 8/2011 |
| EP | 3088314 | A1 | 11/2016 |

*Primary Examiner* — Anh V La

(74) *Attorney, Agent, or Firm* — Skaar Ulbrich Macari, P.A.

(57) ABSTRACT

Lighting elements are disposed within the enclosure doors surrounding an automated material handling machine such as a packaging machine. The clear panels in the door are edge-lit so that the entire door window corresponding to the location of the maintenance notice is illuminated a contrasting color to call the operator's quick attention to that portion of the machine. A method of notifying the operator of a maintenance issue in a particular portion of the machine is provided by illuminating a window panel in a door of the machine enclosure.

16 Claims, 4 Drawing Sheets

(56) References Cited

U.S. PATENT DOCUMENTS

| | | | | |
|---|---|---|---|---|
| 8,021,009 | B2 | 9/2011 | Knöll et al. | |
| 8,668,292 | B2 | 3/2014 | Pae | |
| 9,297,538 | B2 | 3/2016 | Hargrave et al. | |
| 9,677,756 | B1 | 6/2017 | Johnson | |
| 2002/0165623 | A1* | 11/2002 | Haller | G05B 17/02 700/31 |
| 2004/0003573 | A1* | 1/2004 | Moore | B65B 17/025 53/48.1 |
| 2005/0097846 | A1 | 5/2005 | Zocco | |
| 2006/0027342 | A1 | 2/2006 | Maher | |
| 2006/0080873 | A1 | 4/2006 | Riopel et al. | |
| 2007/0033903 | A1 | 2/2007 | Gertitschke et al. | |
| 2008/0024047 | A1 | 1/2008 | Juo et al. | |
| 2008/0158858 | A1 | 7/2008 | Madireddi et al. | |
| 2008/0184636 | A1 | 8/2008 | Fisher | |
| 2010/0117496 | A1 | 5/2010 | Clarke et al. | |
| 2011/0061505 | A1* | 3/2011 | Begin | B23D 45/003 83/72 |
| 2013/0258706 | A1 | 10/2013 | Urtiga et al. | |
| 2015/0130609 | A1* | 5/2015 | Jacobs | G08B 25/12 340/517 |
| 2015/0290853 | A1* | 10/2015 | Hoshikawa | B29C 45/1774 362/418 |
| 2016/0095450 | A1 | 4/2016 | Trulaske, Sr. | |
| 2018/0127134 | A1 | 5/2018 | Squires | |

* cited by examiner

ILLUMINATED DOOR INDICATOR FOR AUTOMATED MACHINERY

PRIORITY

This application claims the priority benefit of U.S. Provisional Application No. 62/719,967, filed on Aug. 20, 2018, which is hereby incorporated herein by reference in its entirety.

FIELD

The present invention relates generally to automated machinery such as packaging machines, and more particularly, to automated machinery that provides a machine status indication to an operator in an exterior door panel thereof.

BACKGROUND

There are many types of automated machinery for handling and packaging of articles that include multiple stages or segments forming the machine. Such machines can be quite large, such as 20, 30 or more feet long, and sometimes more than one level in height. Naturally, there are many moving parts throughout the machine that are controlled by one or more computing systems of the machine. These machines often run at high speeds and run continuously for many hours at a time. Many issues can occur that require a technician or operator to provide maintenance to the machine.

The machines are typically equipped with many sensors that will sense when the machine has malfunctioned, jammed or otherwise needs maintenance. A cylindrical light tree is usually provided atop the machine to indicate the operational status of the machine. A green light illuminated by the light tree means that no maintenance issues have been detected. A yellow light illuminated on the tree indicates a warning or the machine requires tending. A red light illuminated on the tree indicates that the machine requires maintenance.

The yellow and red lights on the tree are nonspecific. That means the operator or technician only knows that the machine requires maintenance somewhere within the machine. As a result, the operator or technician must perform a manual inspection of the machine or must interact with a control panel to determine what triggered the fault indication. This can be quite time consuming due to the large size and complexity of the machine.

Attempts have been made to place lights above sections of the machine and illuminate a section corresponding to the section in need of maintenance or operator attention. However, these lights are still too general to quickly call the operator's attention to a specific portion of the machine. Therefore, there remains a need to improve the notifications provided to the operators/technicians of large automated material handling machinery.

SUMMARY

The disclosure addresses the problems discussed above by providing lighting elements within the enclosure doors surrounding the machine. The clear panels in the door are edge-lit, effectively illuminating the entire clear panel, so that the door window corresponding to the location of the maintenance notice is illuminated a contrasting color to call the operator's quick attention to that portion of the machine. The disclosure also includes a method of notifying the operator of a maintenance issue in a particular portion of the machine by illuminating a window panel in a door of the machine enclosure.

The disclosure includes a packaging machine. The machine includes an enclosure surrounding internal components of the packaging machine. The enclosure defines a plurality of doors. Each of the plurality of doors can be opened for an operator to access a portion of the internal components. Each of the plurality of doors comprises a door frame, a window disposed within the door frame, and a light that is arranged within the door frame so as to light the window via an edge of the window so that the window will glow when the light is illuminated.

The light can be a strip of light emitting diodes (LEDs). The window can be a clear acrylic panel that is configured to illuminate perpendicular to the flat front surface of the panel when lit from the edge of the window. The window also can be tinted or can be semi-opaque.

The light can be red or other contrasting color when illuminated.

Service lighting can be disposed above the machine so that a selected portion of the internal components can be illuminated. A status tree light also can be provided to the machine and extending vertically above machine.

The enclosure can define a perimeter with more than one side. One of the doors can be provided to more than one of the sides or even to all of the sides of the perimeter.

An onboard computer can be coupled to the light for each of the plurality of doors. The onboard computer is configured to illuminate a specific one of the plurality of doors closest to a portion of the internal components needing service by the operator. The computer can also be configured to flash the door light. In another example, the computer can be configured to illuminate all of the doors in a first color, but illuminate the specific one of the plurality of doors closest to the portion of the internal components needing service by the operator in a second color, which is different than the first color. For example the first color could be green and the second color could be red.

The disclosure further includes a method of brining attention to a specific portion of a packaging machine. The method includes providing a light in each of the plurality of doors that is arranged to illuminate the window of the door via an edge of the window and illuminating a specific one of the plurality of doors of the packaging machine closest to a portion of the internal components needing attention by the operator by projecting light into the edge of the window to illuminate the window.

The light can be a contrasting color such as red. The LED strip that provides the light to the edge of the window can be disposed within a pocket defined into a frame of the door.

The disclosure further includes an illuminated exterior door for a packaging machine. The door includes a window, a door frame surrounding the window, a pocket defined into the door frame and aligned with an edge of the window, and an LED strip disposed within the pocket and arranged to project light into the edge of the window.

The window can be an acrylic panel that is configured to illuminate perpendicular to a flat front surface of the panel when lit from the edge thereof. The window can be tinted or semi-opaque.

A computer can be coupled to the LED strip and can be configured to selectively illuminate the LED strip.

The above summary is not intended to limit the scope of the invention, or describe each embodiment, aspect, implementation, feature or advantage of the invention. The detailed technology and preferred embodiments for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 1:
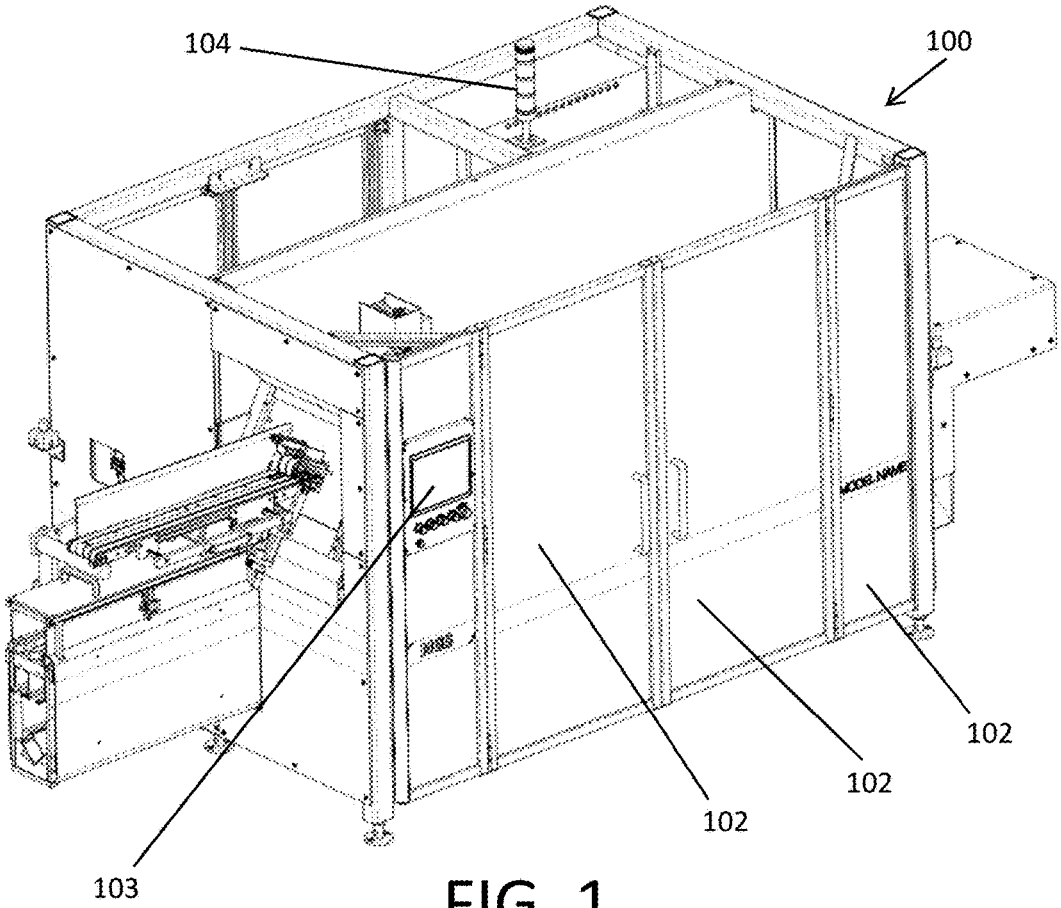
FIG. 1 is a perspective view of a packaging machine according to certain embodiments.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the scope of the invention as defined by the appended claims.

DETAILED DESCRIPTION

In the following descriptions, the present invention will be explained with reference to various exemplary embodiments. Nevertheless, these embodiments are not intended to limit the present invention to any specific example, environment, application, or particular implementation described herein. Therefore, descriptions of these example embodiments are only provided for purpose of illustration rather than to limit the present invention. It is understood that the various features and aspects discussed herein may be used in any combination, or in isolation, without departing from the scope of the present invention.

Referring to FIGS. 1-6, it can be seen that the packaging machine 100 includes a plurality of door panels 102 that form an enclosure perimeter that defines an enclosed interior of the machine 100. Portions of the machine performing automated steps of the packaging process are contained within the enclosed perimeter. The material to be packaged is typically introduced at a first end of the machine at A and finished goods are discharged from an opposite end of the machine at B. Between these input and output areas (A, B), the material being packaged may undergo a series of steps that are performed by stages or stations of the machine as the material is passed from one stage to the next.

The machine can be considerably long. For example, packaging machines of 20-30 feet or more are known. The machines can also be more than one story tall. The present invention is not limited to any particular size or configuration of machine. However, the benefit of the invention's advantages multiplies as the size and complexity of the machine increases. The machine also need not be a packaging machine as virtually any type of machine enclosed by a housing with doors or windows therein will benefit from the present invention.

The operator or technician (herein collectively referred to as the "operator") accesses the enclosed portions of the machine via the doors 102. Thus each door 102 corresponds to a limited portion of the machine. Naturally, the number of doors in the machine perimeter increases as the machine's size increases.

Figure 2:
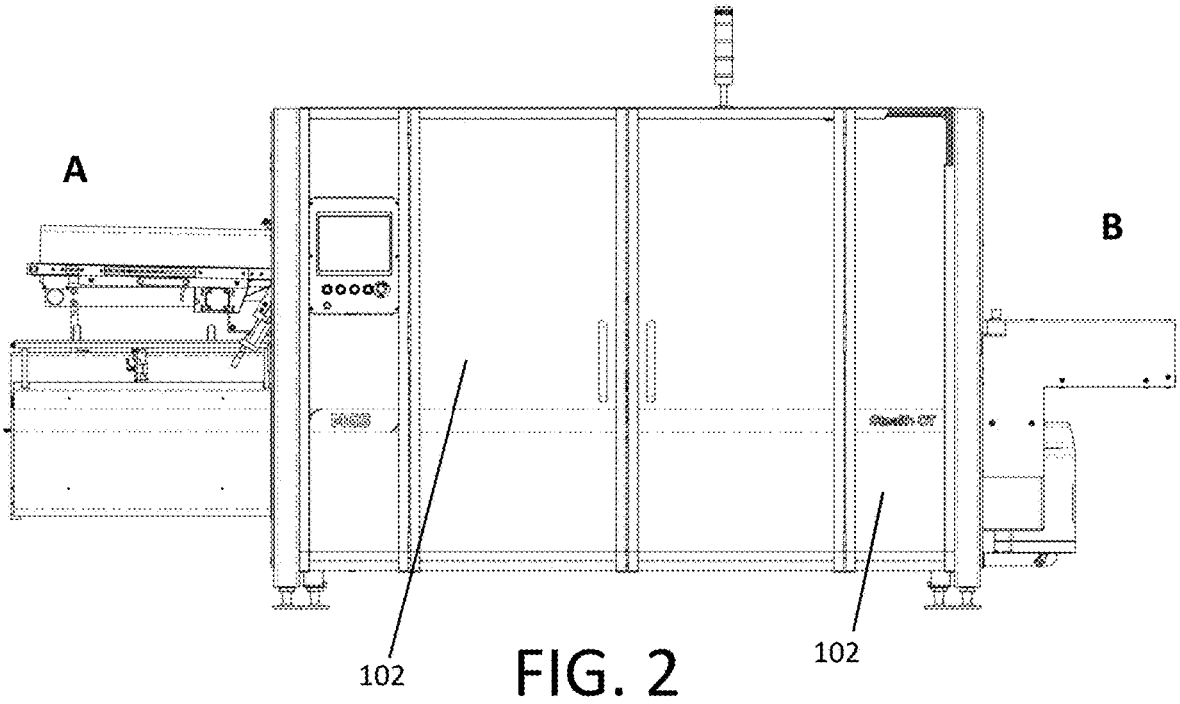
FIG. 2 is a front view of a packaging machine according to certain embodiments.
Figure 5:
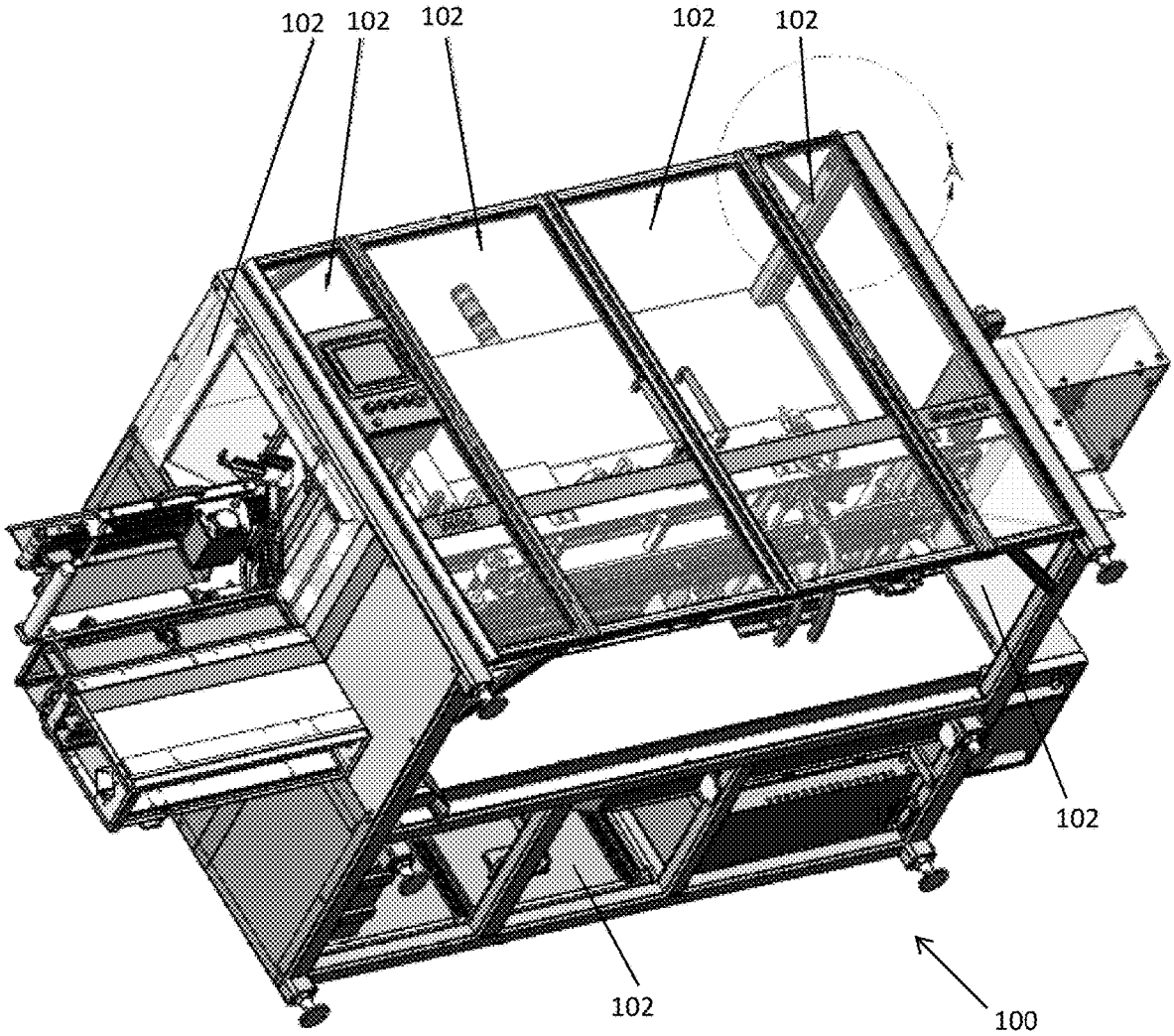
FIG. 5 is a perspective view of a packaging machine according to certain embodiments.

FIGS. 1-2 and 5 show a packaging machine in accordance with the present invention. It can be seen that the doors 102 allow the operator to access the internal components of the machine. A conventional status light tree 104 extends above the machine to provide a general indication of the machine operational status. For example, a green light may be illuminated to designate a machine operating normally. A yellow light may indicate a standby mode or input materials are low, but that the machine continues to operate at the moment. A red light being illuminated can designate a machine that requires immediate operator attention.

Figure 3:
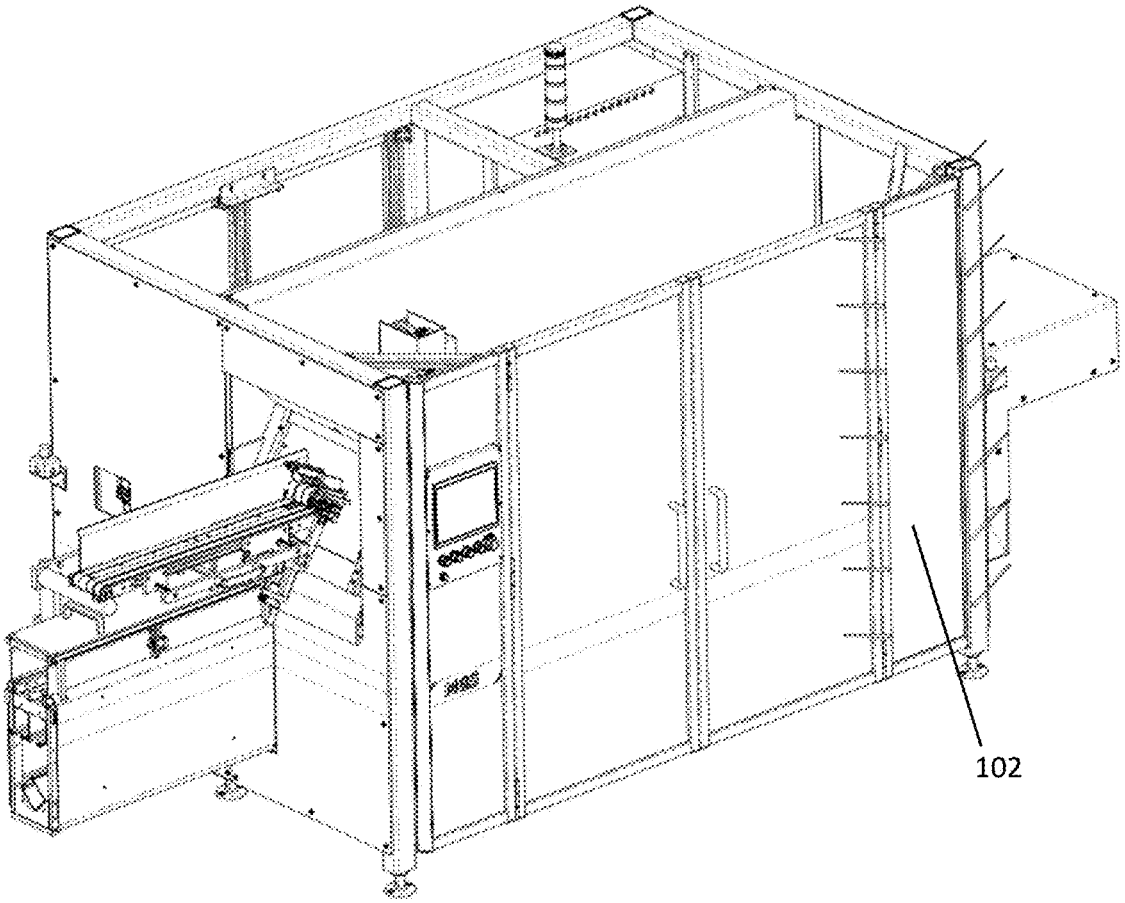
FIG. 3 is a perspective view of the packaging machine of FIG. 1 illustrating an illuminated door panel according to certain embodiments.
Figure 4:
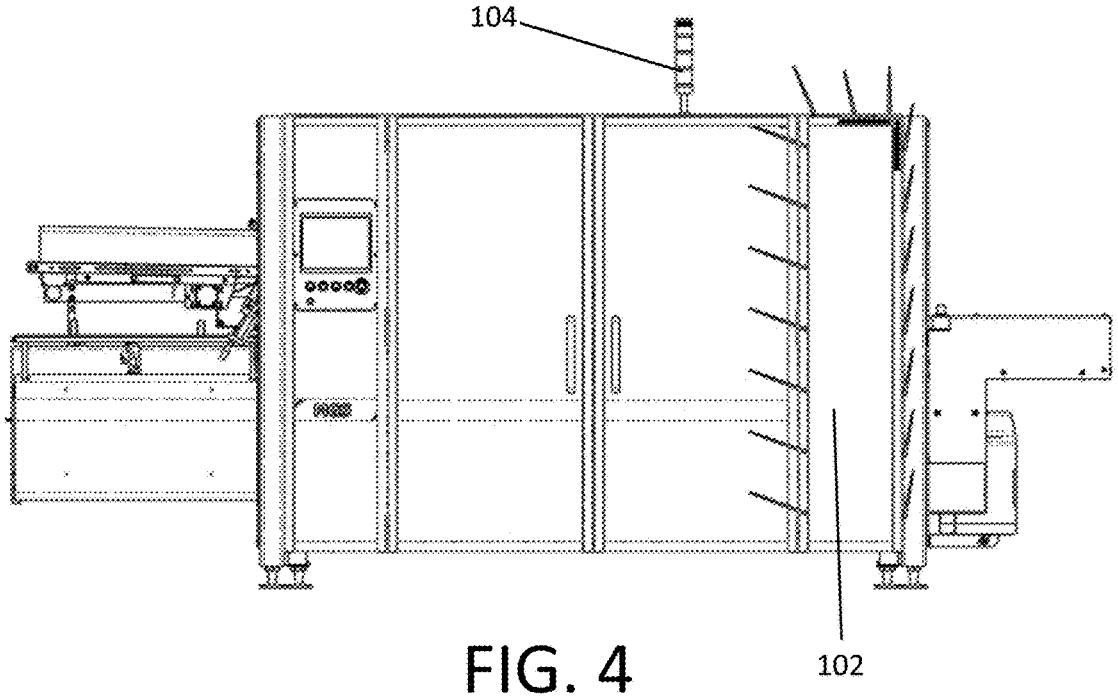
FIG. 4 is a front view of the packaging machine of FIG. 2 illustrating an illuminated door panel according to certain embodiments.

FIGS. 3-4 show the same machine as FIGS. 1-2, but the far right door or window panel of the machine is being illuminated (as noted by the outward projecting rays in the figures) to illustrate that the normally clear panel is illuminated with a colored light. The light color can be red to designate an attention needed by the operator.

Packaging machines often are controlled by an onboard computer. The computer controlling the machine 100 is coupled to the lighting for each door, window or panel so that only the door panel 102 corresponding to the location of the reason for the fault condition will be illuminated. Upon sensing an issue requiring operator attention (e.g., a jam), the computer selectively illuminates the door corresponding to the location of the internal component needing the operator's attention. After remedying the situation causing the computer to call for operator service, the operator can interact with the computer via the control panel 103 to clear or reset the service notice and the door panel will return to normal status (e.g., non-lit).

In another embodiment, all panels can be illuminated in one color (e.g., green) while the panel corresponding to the portion of the machine needing attention is illuminated in a contrasting color (e.g., red). Of course, other color combinations and illumination schemes can be provided. The colors of the illuminated panels can match the color tree 104 light scheme.

The illuminated panel can also be flashed or strobed. The flashing/strobing may be immediate upon illumination, or can be used to escalate the notification if the operator does not open the door or reset the machine via the control panel within a predetermined period of time. The intensity or brightness of the light can also be varied if the operator does not open the door or reset the machine via the control panel within a predetermined period of time.

Additional service lighting can also be provided above the portion of the machine to be serviced by the operator. The service lighting is preferably a white-shade of light to aide in the examiner's inspection and work on the machine. The service light can be triggered by the door being opened so that the illuminated door panel is not washed out by the service lighting.

The invention provides a focused attention of the operator in the exact section of the machine where the condition occurred that caused the computer control to request operator attention. This speeds up the ability of the operator to diagnose and correct the condition. Thus, the machine can be more quickly returned to normal operation as compared to conventional solutions discussed herein above.

The illuminated panels 102 can be provided to more than one side of the machine. For example, in FIG. 5, the illuminated panels 102 are on all four sides of the machine 100.

Figure 6:
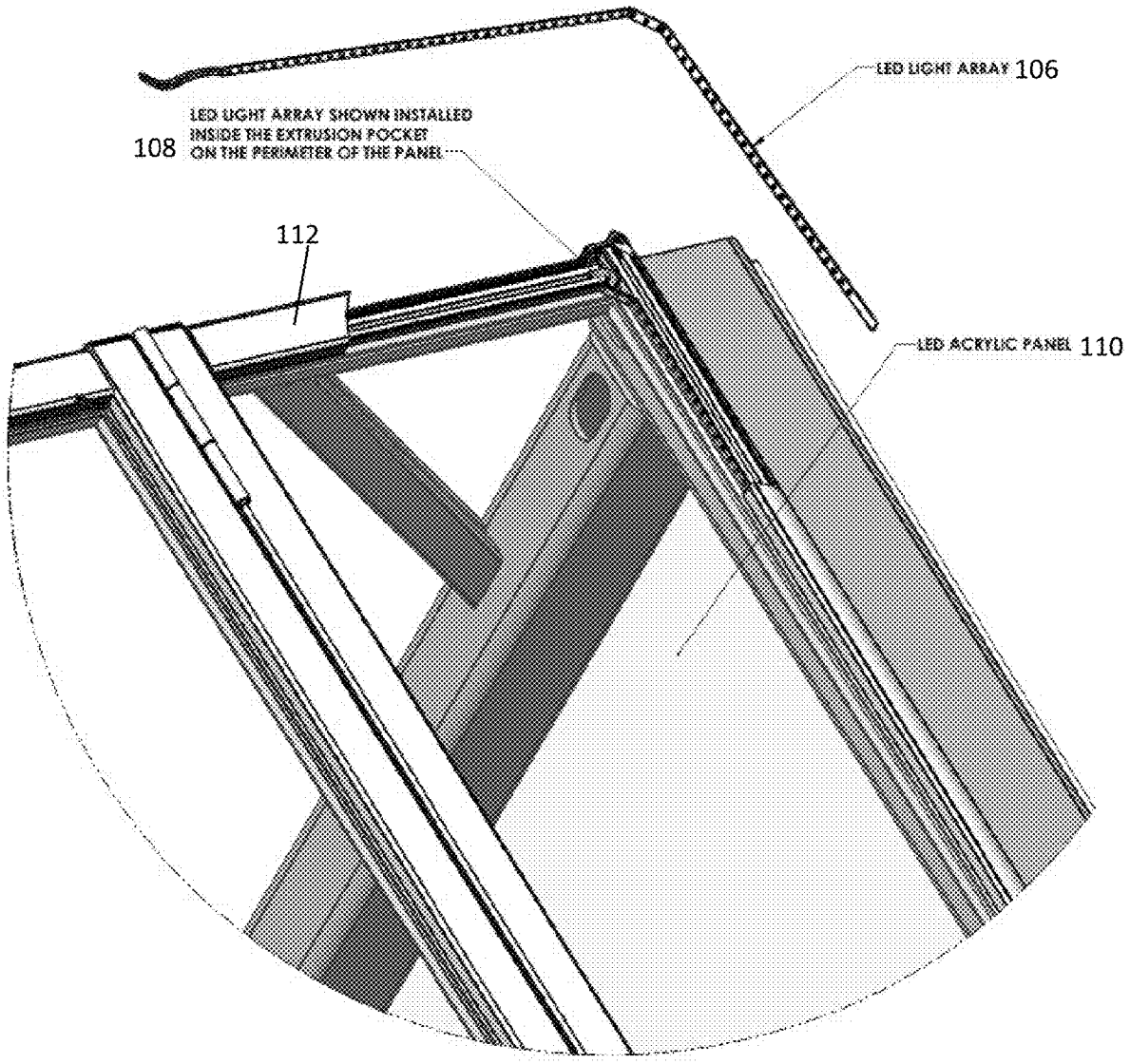
FIG. 6 is an enlargement of portion A indicated in FIG. 5.

FIG. 6 illustrates the construction of the illuminated door panel. A LED light array or strip 106 is disposed along the inner side of the door frame 108. A pocket in the frame 108 can be provided for this purpose. The LED strip 106 aligns with the edge of the clear panel 110 that forms the center of the door. The clear panel 110 can be a LED acrylic panel that is configured to illuminate perpendicular to the flat front surface of the panel when lit from its edge. Exterior trim 112 covers the door frame to provide a finished appearance.

The panel 110 need not be completely clear. For example, the panel can be tinted or be semi-opaque.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products. Moreover, features or aspects of various example embodiments may be mixed and matched (even if such combination is not explicitly described herein) without departing from the scope of the invention.

What is claimed is:

1. A packaging machine, comprising:

an enclosure surrounding internal components of the packaging machine, the enclosure defining a plurality of doors, each of the plurality of doors are openable for an operator to access a portion of the internal components, wherein each of the plurality of doors comprises a door frame, a window disposed within the door frame, and a light that is arranged within the door frame so as to light the window via an edge of the window so that the window will glow when the light is illuminated.

2. The packaging machine of claim 1, wherein the light is a strip of light emitting diodes (LEDs).

3. The packaging machine of claim 1, wherein the window is a clear acrylic panel that is configured to illuminate perpendicular to the flat front surface of the panel when lit from the edge of the window.

4. The packaging machine of claim 1, wherein the light is red when illuminated.

5. The packaging machine of claim 1, further comprising service lighting disposed above the machine so that a selected portion of the internal components can be illuminated.

6. The packaging machine of claim 1, wherein the enclosure defines a perimeter with more than one side, and wherein there is at least one door on a first side of the perimeter and one door on a second side of the perimeter.

7. The packaging machine of claim 1, wherein the enclosure defines a perimeter with more than one side, and wherein there is at least one door on each side of the perimeter.

8. The packaging machine of claim 1, further comprising an onboard computer coupled to the light for each of the plurality of doors, wherein the onboard computer is configured to illuminate a specific one of the plurality of doors closest to a portion of the internal components needing service by the operator.

9. The packaging machine of claim 8, wherein the computer is configured to flash the light for the specific one of the plurality of doors closest to the portion of the internal components needing service by the operator.

10. The packaging machine of claim 8, wherein the computer is configured to illuminate all of the plurality of doors in a first color, and wherein the computer is configured to illuminate the specific one of the plurality of doors closest to the portion of the internal components needing service by the operator in a second color, the second color being different than the first color.

11. The packaging machine of claim 10, wherein the first color is green and the second color is red.

12. The packaging machine of claim 1, further comprising a status tree light provided to the machine and extending vertically above machine.

13. The packaging machine of claim 1, wherein the window is tinted or is semi-opaque.

14. A method of bringing attention to a specific portion of a packaging machine, the packaging machine including a plurality of doors for accessing internal components of the machine, each of the doors including a window disposed therein, the method comprising:

providing a light in each of the plurality of doors that is arranged to illuminate the window of the door via an edge of the window; and illuminating a specific one of the plurality of doors of the packaging machine closest to a portion of the internal components needing attention by the operator by projecting light into the edge of the window to illuminate the window.

15. The method of claim 14, wherein the light projected into the window is red.

16. The method of claim 14, wherein the step of providing a light in each of the plurality of doors includes disposing an LED strip within a pocket defined into a frame of the door.

* * * * *